US008641144B2

(12) United States Patent
Davis, Jr. et al.

(10) Patent No.: US 8,641,144 B2
(45) Date of Patent: Feb. 4, 2014

(54) SWIVELING CHAIR WITH ELECTRICAL PASS-THROUGH

(76) Inventors: Wendell R. Davis, Jr., Reno, NV (US); Dale Robert Lundeen, Washoe Valley, NV (US); Kay Daniel Vetter, Reno, NV (US)

( * ) Notice: Subject to any disclaimer, the term of this patent is extended or adjusted under 35 U.S.C. 154(b) by 429 days.

(21) Appl. No.: 12/945,244

(22) Filed: Nov. 12, 2010

(65) Prior Publication Data

US 2011/0109135 A1 May 12, 2011

Related U.S. Application Data

(60) Provisional application No. 61/260,603, filed on Nov. 12, 2009.

(51) Int. Cl.
*A47C 1/00* (2006.01)

(52) U.S. Cl.
USPC ..... 297/344.22; 297/137; 297/256.12; 297/344.21; 248/415; 248/417; 248/418

(58) Field of Classification Search
USPC ..... 248/415, 417, 418, 188.1, 349.1; 297/137, 256.12, 344.21, 344.22, 297/217.4
See application file for complete search history.

(56) References Cited

U.S. PATENT DOCUMENTS

| | | | | |
|---|---|---|---|---|
| 3,188,043 | A | 6/1965 | Dlouhy et al. | |
| 3,438,606 | A * | 4/1969 | Rubin | 248/415 |
| 3,570,800 | A * | 3/1971 | Cycowicz | 248/415 |
| 3,593,954 | A * | 7/1971 | Ritchie et al. | 248/215 |
| 3,834,660 | A | 9/1974 | Leffler | |
| 4,217,628 | A * | 8/1980 | Windom | 362/483 |
| 4,226,398 | A * | 10/1980 | Freber | 248/415 |
| 5,568,960 | A | 10/1996 | Oleson et al. | |
| 5,685,514 | A * | 11/1997 | Carnahan et al. | 248/425 |
| 5,779,309 | A * | 7/1998 | Lu | 297/344.26 |
| 5,782,451 | A | 7/1998 | Carnahan et al. | |
| 5,810,441 | A * | 9/1998 | Ezuka et al. | 297/344.26 |
| 6,338,464 | B1 * | 1/2002 | Jen-Hsiang | 248/349.1 |
| 6,575,420 | B2 * | 6/2003 | Yoshida et al. | 248/425 |
| D529,727 | S | 10/2006 | Bartlett et al. | |
| 7,547,067 | B2 * | 6/2009 | Keilhauer et al. | 297/313 |
| 7,694,930 | B2 * | 4/2010 | Ritter et al. | 248/415 |
| 2002/0070590 | A1 | 6/2002 | Carstens | |
| 2003/0189370 | A1 * | 10/2003 | Hemmer et al. | 297/344.11 |
| 2004/0140699 | A1 * | 7/2004 | Akpom | 297/217.4 |

FOREIGN PATENT DOCUMENTS

| | | |
|---|---|---|
| JP | 2002125786 | 5/1998 |
| WO | WO 97/16092 | 5/1997 |

* cited by examiner

*Primary Examiner* — Terrell McKinnon
*Assistant Examiner* — Michael McDuffie
(74) *Attorney, Agent, or Firm* — Novak Druce Connolly Bove + Quigg LLP; Jonathan Jaech

(57) ABSTRACT

A bi-plate ball bearing is configured for horizontally mounting between a base and a chair. The ball bearing has an upper plate and a lower plate defining a ball bearing race and a tension member holding the plates together disposed through a central rotational axis of the bi-plate ball bearing. The tension member may be configured as a threaded metal tube fixed to a first one of the upper plate and the lower plate and held to a second one of the upper plate and the lower plate by a nut. The threaded metal tube defines a passage through the central rotational axis of the bi-plate ball bearing through which power and control wiring may pass. The bearing may provide a cost-effective swivel bearing for chair that includes powered electronics, for which it is desired to pass wiring from the swiveling chair into a chair base.

16 Claims, 7 Drawing Sheets

SWIVELING CHAIR WITH ELECTRICAL PASS-THROUGH

RELATED APPLICATION

This application claims priority pursuant to 35 U.S.C. §119 (e) to U.S. provisional application Ser. No. 61/260,603, filed Nov. 12, 2009, which application is specifically incorporated herein, in its entirety, by reference.

BACKGROUND

1. Field

The present disclosure relates to swiveling chairs that include electrically wired devices above the swivel.

2. Description of Related Art

Swiveling chairs may be constructed using a pedestal or legged base supporting a chair seat, and a mechanical swivel, such as a ball bearing, interposed between the seat and the base. A ball bearing swivel may be disposed horizontally between the base and the seat, and bear the weight of the seat and its occupant through the balls and races of the ball bearing. Ball bearings provide a smooth, quiet, and nearly frictionless swiveling action, relative to other bearing types. In such chairs, the ball bearing swivel provides the only practical structure for attaching the seat to the base. As such, the swivel must also carry a tension load to prevent separation of the chair from the base. Separation loads typically vary periodically between zero and peak values as occupants of the chair do not sit perfectly still but instead shift their center of gravity away from the load center of the swivel.

Accordingly, ball bearings used in swivel chairs should be capable of bearing varying tension and thrust loads while swiveling. Certain bearing types, such as precision tapered roller bearings, are designed for bearing axial loads in thrust and can be modified to carry significant tension loads, but are prohibitively expensive for most chair applications. A more cost-effective ball bearing used in many swiveling chairs comprises upper and lower stamped metal plates that fit together to provide a race for steel balls set therein. The plates are axially fastened by a centrally-disposed tension fastener, such as a pin, rivet, or bolt, which bears the tension loads imposed on the swivel by use of the chair and serves as a pivot for the swivel assembly.

The centrally-disposed tension fastener and adjoining two plates form a critical structural part of such swiveling chair assemblies. This part needs to have adequate strength and fracture toughness to last the expected life of the chair without failure, while imparting a feeling of solidity to the chair seat. This is particularly important for seats that include high seat backs, which enhance user comfort but also add a lever arm that can greatly increase tension stress on the swivel when the user leans back. Therefore it is particularly important to provide a robust, yet cost-effective swivel mechanism for high-backed swiveling chairs.

Chairs of both the swiveling and static variety have been provided with wired electrical devices in the seat structure. For example, seats have been wired with audio speakers or with motors for massage devices or other applications. In a static chair, wires can simply be passed through the column pedestal base of the chair into the seat upholstery and routed to the electrical device. In a swiveling chair, an electrical conductor must somehow bridge the swiveling mechanical connection between the base and seat. One solution to this problem is to route a wire from the chair base beyond the outer perimeter of the swivel mechanism and into the upholstery of the chair seat. However, such routing may result in exposing the wire outside of the chair envelope, which is esthetically unattractive. Such routing may also subject the wire to frequent flexure, or to risks of being snagged or cut, which is functionally undesirable. It would be therefore desirable to provide a wired swiveling chair without these and other disadvantages of currently available designs.

SUMMARY OF THE INVENTION

A swiveling chair with an electrical pass-though between the base and the seat is disclosed herein, wherein an internally-disposed wire carries an electrical connection between the base and the seat. Advantageously, the chair uses a stamped metal bi-plate ball bearing swivel as the swiveling connection between the base and the seat, providing the cost-effectiveness of this proven design. However, the bi-plate ball bearing swivel is specially modified to allow passage of a wire through a central rotational axis of the swivel. The wire is routed through this axis, avoiding exposure outside of the chair envelope and avoiding significant flexure or breakage risk.

In an embodiment, a bi-plate ball bearing is configured for horizontally mounting between a base and a chair. The ball bearing comprises an upper plate and a lower plate defining a ball bearing race therebetween and a tension member disposed through a central rotational axis of the bi-plate ball bearing holding the upper plate to the lower plate. The tension member may comprises a threaded metal tube fixed to a first one of the upper plate and the lower plate and held to a second one of the upper plate and the lower plate by a nut. The threaded metal tube defines a passage through the central rotational axis of the bi-plate ball bearing.

A chair seat may be attached to the upper plate of the bi-plate ball bearing, and a chair base for supporting the seat above a floor or the like may be attached to the lower plate of the bi-plate ball bearing. At least one electrical wire may pass through the threaded metal tube to provide an electrical connection between the chair seat and chair base, without impairing swiveling action provided by the ball bearing.

BRIEF DESCRIPTION OF THE DRAWINGS

An understanding of the swiveling chair with electrical pass-through will be afforded to those skilled in the art, as well as a realization of additional advantages and objects thereof, by a consideration of the following description. Reference will be made to the appended sheets of drawings which will first be described briefly.

FIG. 3 is an assembly drawing showing an example of a swiveling chair with electrical pass-through.

FIG. 6 is an exploded assembly drawing showing the swiveling chair with electrical pass-through.

FIGS. 7A-C are exploded, plan, and side assembly views, respectively, of an alternative swivel with a centrally-located electrical pass-through.

Like reference numerals are used to indicate like elements appearing in one or more of the drawings.

DETAILED DESCRIPTION

Figures 1, 2:
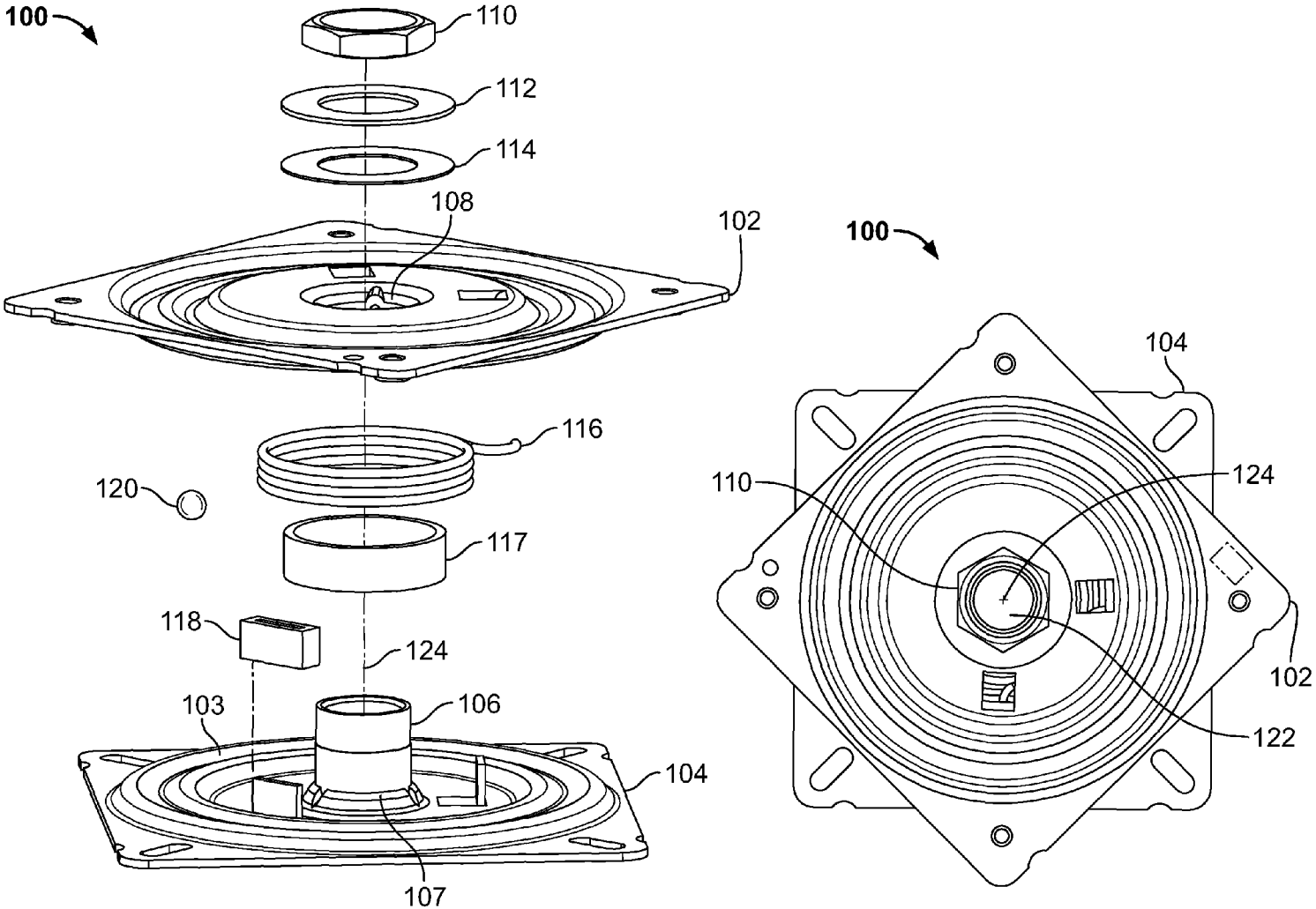
FIG. 1 is an exploded assembly drawing showing an example of a swivel with a centrally located electrical pass through for a swiveling chair.
FIG. 2 is a plan view of the assembly shown in FIG. 1.
Figure 3:
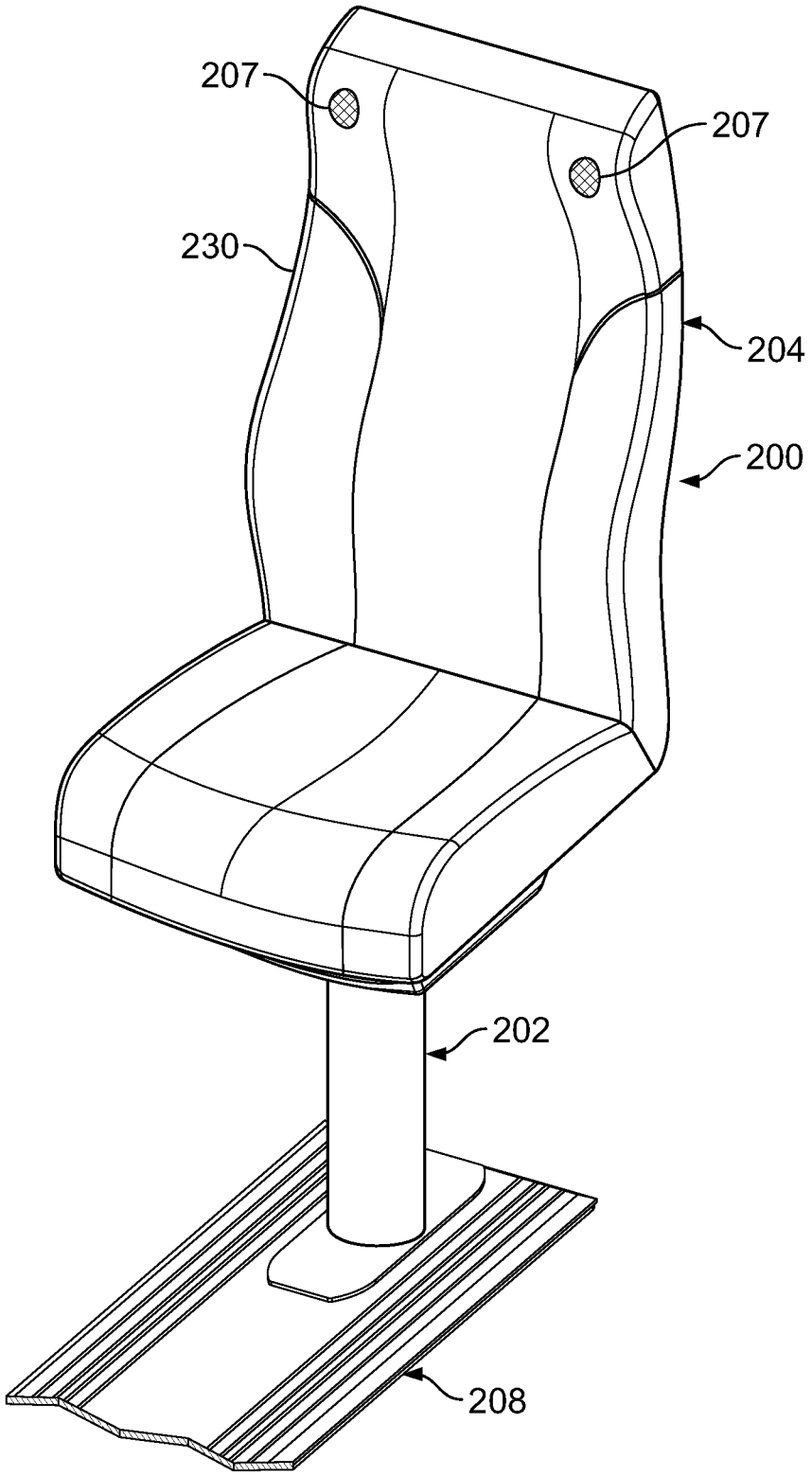
Figure 4:
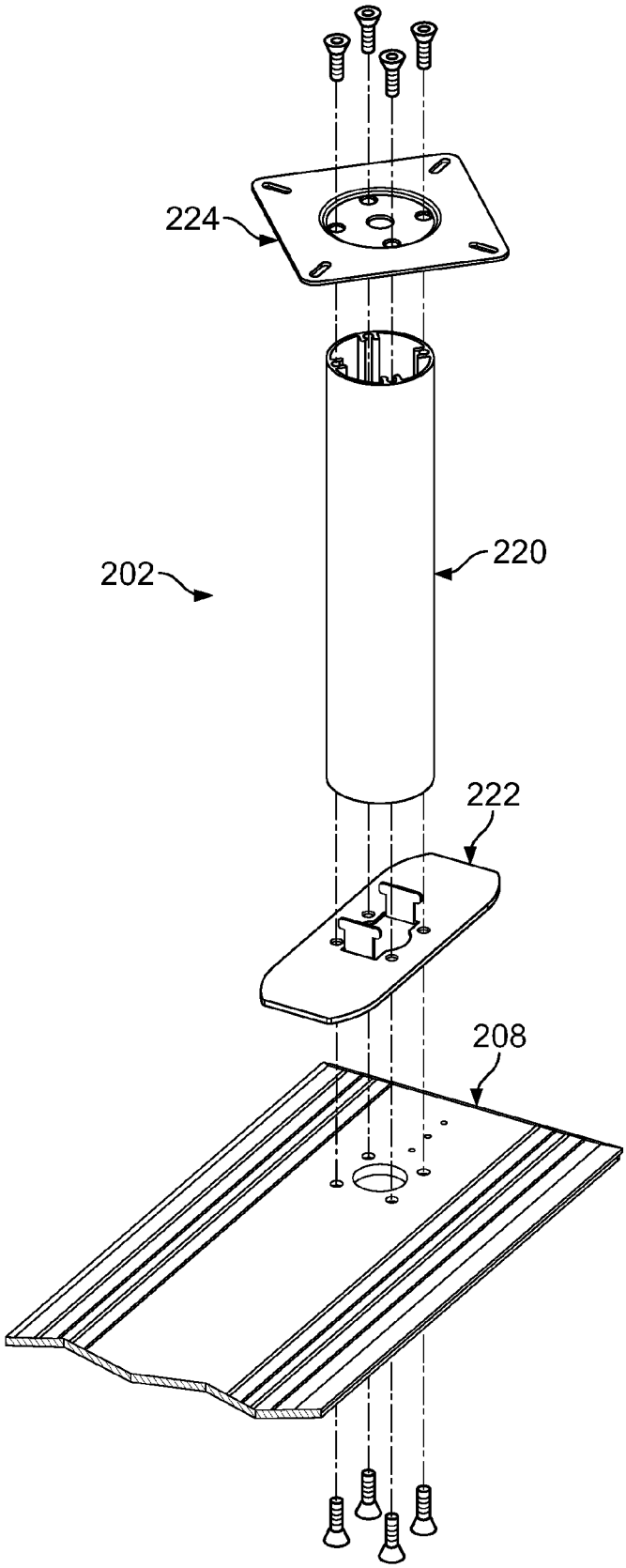
FIG. 4 is an exploded assembly drawing of the chair base assembly for the swiveling chair.
Figure 5:
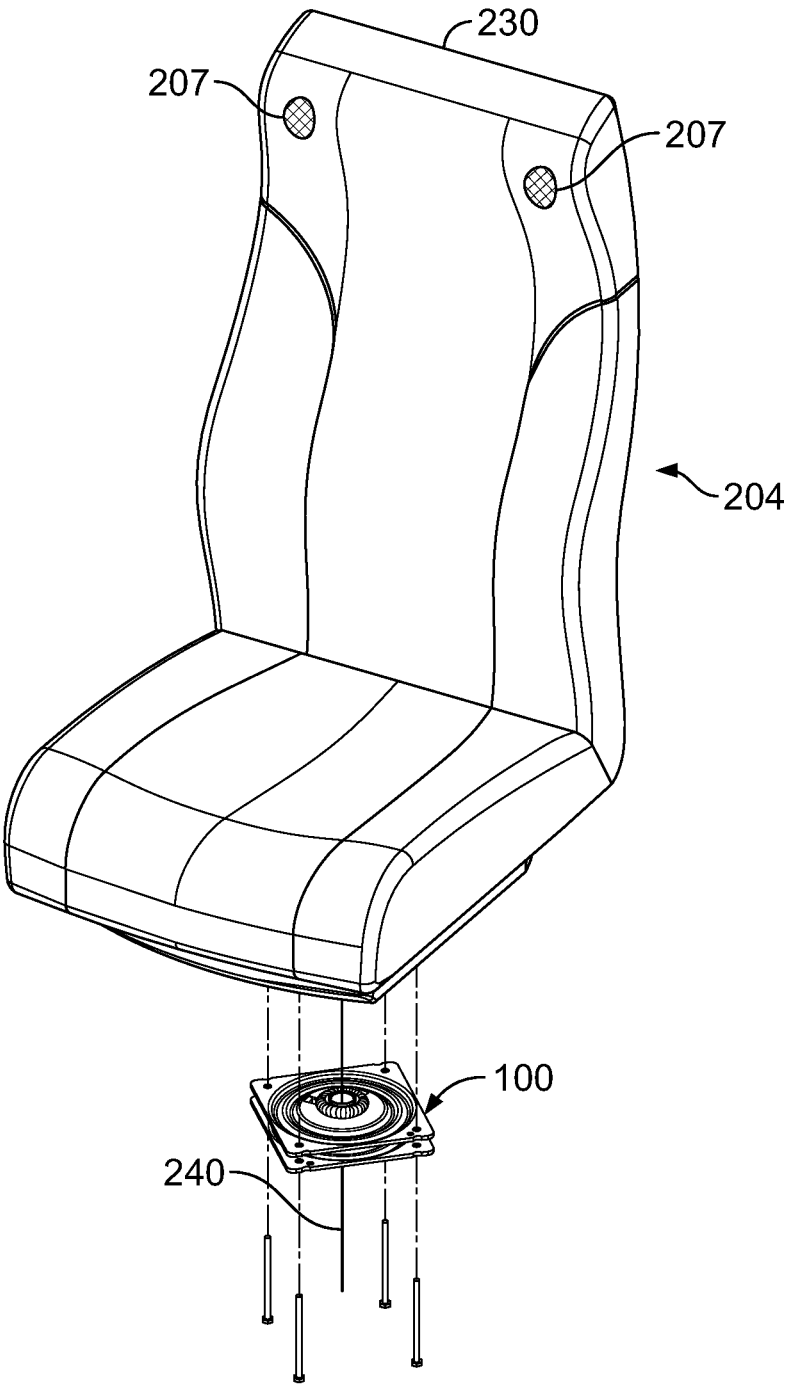
FIG. 5 is an exploded assembly drawing of the seat assembly for the swiveling chair.
Figure 6:
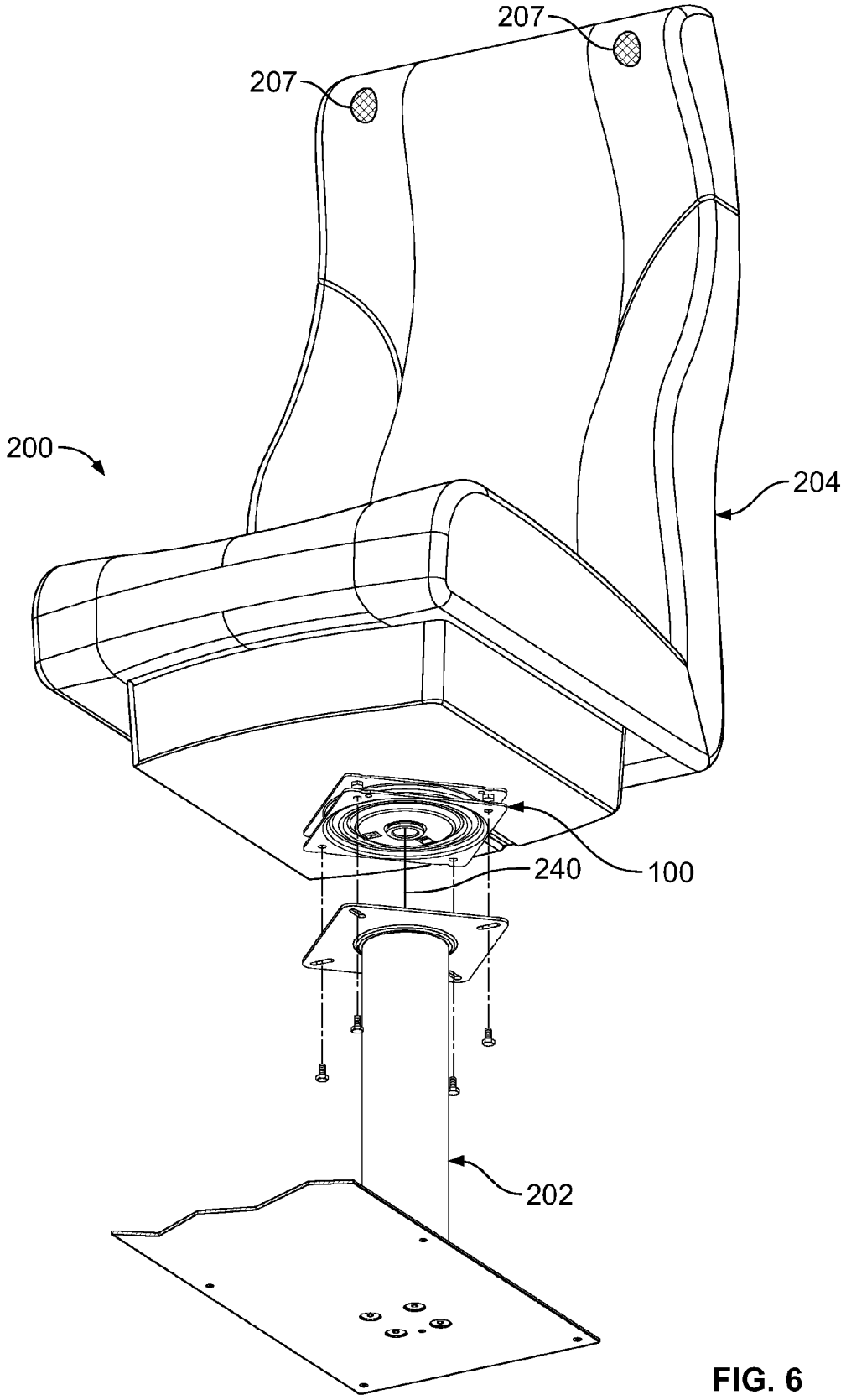
Figure 7B:
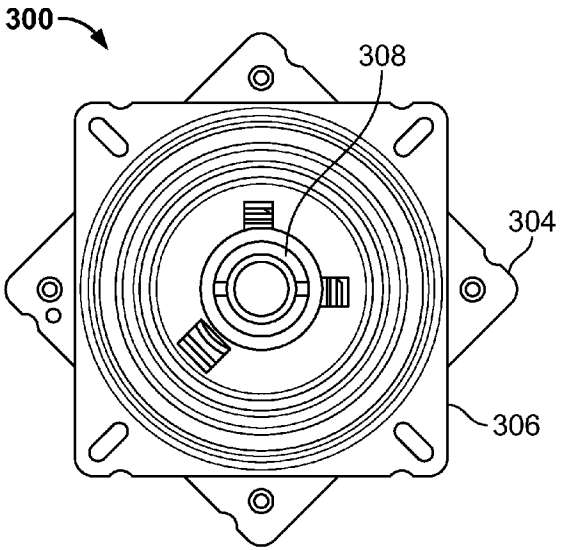
Figure 7C:
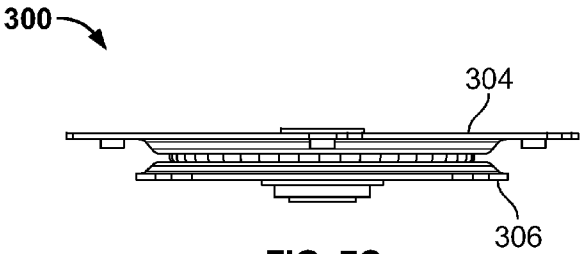
Figure 7A:
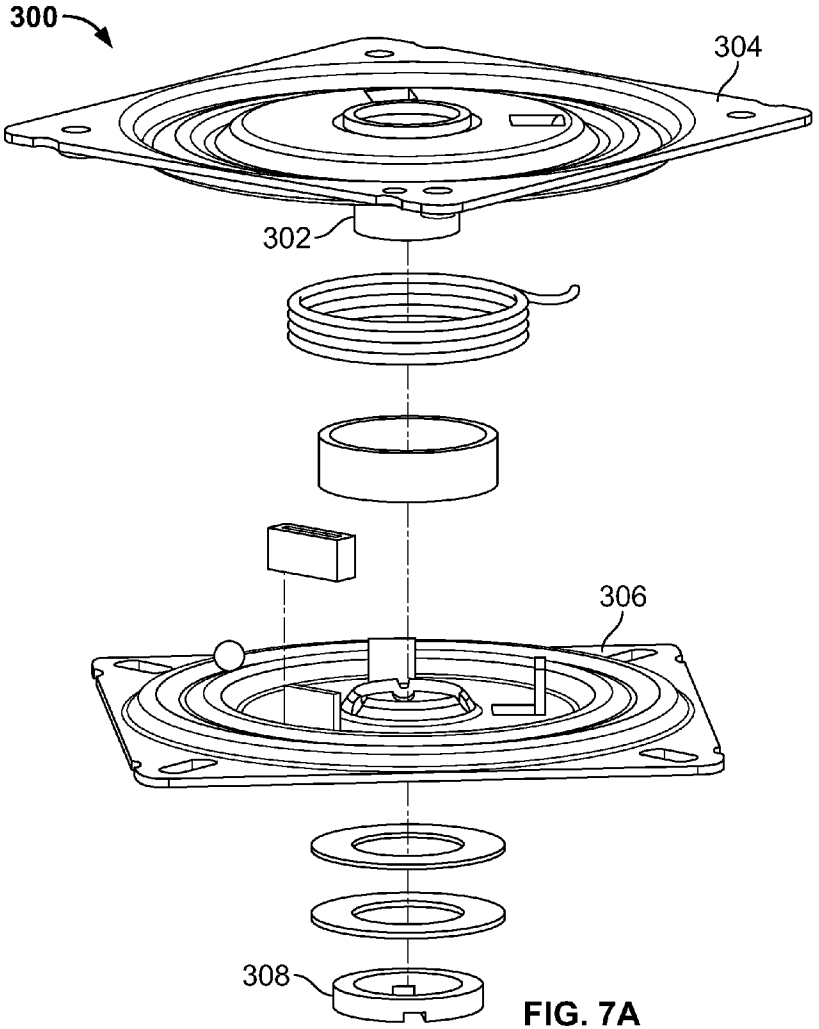
Figure 8A:
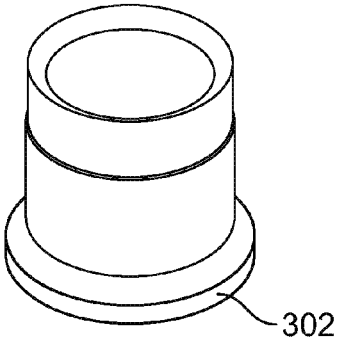
FIGS. 8A-E are various views of a threaded collar for use with the swivel shown in FIGS. 7A-C.
Figure 8B:
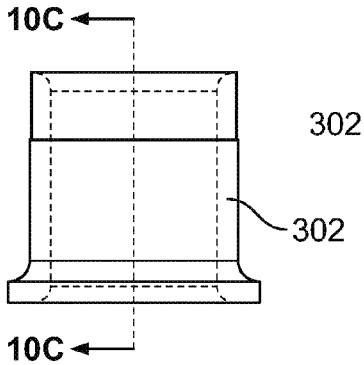
Figure 8C:
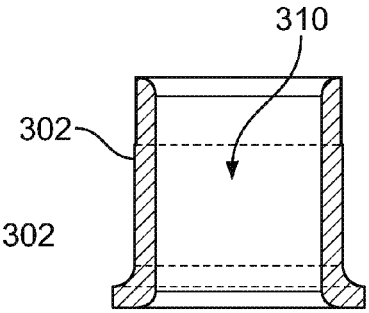
Figure 8D:
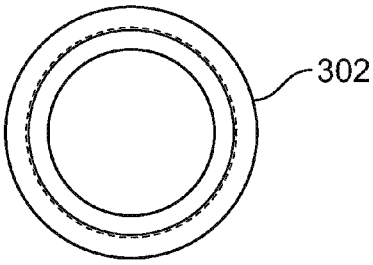
Figure 8E:
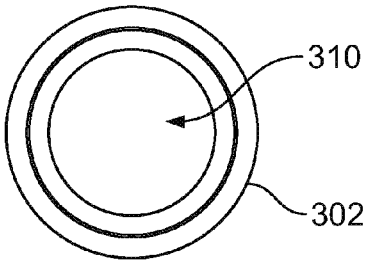

FIGS. 1 and 2 show an example of a bi-plate ball bearing swivel with an electrical pass-through 100. Swivel 100 comprises an upper plate 102 and a lower plate 104 forming a race 103 for two or more bearing balls 120 therebetween. The upper and lower plates may be formed from stamped metal plate, such as steel plate. A threaded metal tube 106, such as a steel tube, is fixed around a perimeter of a centrally disposed opening 107 in the lower plate, such as by pressing, brazing, and/or welding. The metal tube 106 is designed to withstand steady and fluctuating tensile and bending loads over the life of the chair 200, and may comprise the sole load-bearing structure attaching the seat assembly and base assembly within swivel 100. In other words, the bi-plate ball bearing lacks any additional load-bearing structure attaching the upper plate and lower plate, besides the threaded tube and components directly attached to the tube. The metal tube 106 comprises a tension member, in that it is loaded in tension in the assembled swivel 100. Normally, the metal tube is loaded in constant tension by a nut or other fastener, as described below. As used herein, a tube includes any generally cylindrical member having two opposite ends and a channel passing through the tube from end to end. The channel may be straight and disposed around the cylindrical axis of the cylindrical member, as in a traditional tube. In the alternative, the channel may be curved or may be disposed around any other line from one end of the cylindrical member to the opposite end of the cylindrical member.

The metal tube 106 passes with clearance through a mating opening 108 in the upper plate 102. A plastic spacer 117 positions a torsion spring 116 around the metal tube 106 with ends of the torsion spring disposed against tabs protruding from the upper and lower plates, respectively. The metal tube is welded on the flared edge of the plate and the nut is welded to the tube. A bumper 118 is disposed over one of the tabs in the lower plate as a rotational stop. The upper plate 102 is held snugly against the lower plate 104 by jam nut 110 threaded around an upper portion of the metal tube 106. Washers 112 and 114 are disposed between the jam nut and the upper plate for load distribution and friction reduction. The assembled swivel 100 provides a passage 122 through swivel 100 disposed along its rotational axis 124.

FIGS. 3-6 show various views of a swiveling chair assembly 200 and components thereof. A seat assembly 204 is mounted to a base assembly 202 using the swivel 100. A pair of speakers 207 or other electrical components may be mounted in the seat back 230, which in this example comprises a high back chair design. A cable 240 passes through the central tube 106 of swivel 100 from the base 202 into seat 204. The cable provides an electrical connection between audio speaker assembly 207 or any other electrically-powered or electronic data device in the seat assembly 204 and a connector for floor plate assembly 208. Electrical devices may include, for example, audio speakers, vibratory or other motors, a display device, or input device such as a joystick or keyboard. Floorplate assembly 208 comprises base plate 212, which is fastened to cover plate 214. A channel may be disposed through floorplate assembly 208 to hold cable 240 between a connector (not shown) and pedestal support bracket 222. The cable runs through the opening in the pedestal support bracket 222, which supports pedestal 220, through the interior of the pedestal, through the swivel attachment bracket 224 and swivel 100, and into the seat base. The pedestal 220 is bolted at its upper end to the seat assembly 204 and swivel 100 through the top plate 224.

Optionally, a removable cable connector (not shown) can be provided in the cable adjacent to swivel 100 to facilitate assembly and disassembly of the base assembly to the seat assembly. Cable slack for facilitating assembly of the base to the seat, and disassembly of the base from the seat, can be accommodated safely inside of the pedestal 220.

Figure 9A:
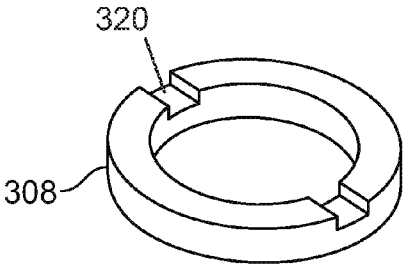
FIGS. 9A-C are various views of a nut used for attaching the threaded collar in the swivel shown in FIGS. 7A-C.
Figure 9B:
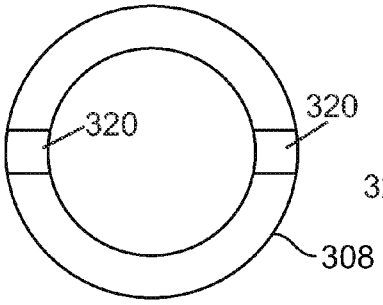
Figure 9C:
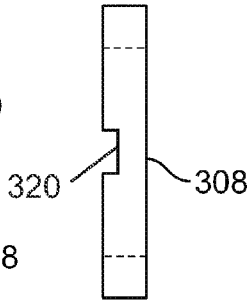

Another example of a swivel 300 with a centrally located electrical pass through for a swiveling chair is shown in FIGS. 9A-C. Swivel 300 is similar to swivel 100 described above, comprising a ball bearing race defined by opposing plates 304 and 306. One difference resides in the threaded collar 302 for attachment to the upper plate 304 in swivel 300. As can more clearly be seen in FIGS. 10A-E, the threaded color 302 may comprise a cylindrical tube portion 312 integrally fixed to a toroidal collar portion 314. An upper portion 316 of the cylindrical tube 312 may be threaded to receive a nut 308. The threaded collar 302 may operate as an electrical pass-through and as a central attachment and pivot for the swivel 300, with the collar portion 314 facilitating assembly and attachment to the upper plate 304 and improved load distribution. It may be attached to the upper plate 304 using any suitable method, for example, welding, brazing, or swaging. The collar 302 may pass through a central opening in the lower plate 306 and held on the reverse side of the lower plate 306 by a nut 308, shown in FIGS. 11A-C. The nut 308 may have a cylindrical outer perimeter 318 and may be threaded on its inner perimeter, and may include a slot 320 or other feature disposed in its outer face 322 to facilitate assembly. Electrical power and signal lines (not shown) may be run through the central channel 310 of collar 302 between a pedestal support and chair base. Other elements of the swivel 300 may be similar or the same as swivel 100.

Having thus described a preferred embodiment of swiveling chair with electrical pass-through, it should be apparent to those skilled in the art that certain advantages of the within system have been achieved. It should also be appreciated that various modifications, adaptations, and alternative embodiments thereof may be made without departing from the scope and spirit of the present technology. For example, a high-backed chair with speakers has been illustrated, but it should be apparent that the novel concepts described above may be applied by one of ordinary skill to chairs with other form factors or other wired electrical devices in the seat to thereby realize the unexpected benefits described herein.

The invention claimed is:

1. An assembly, comprising:

A bi-plate ball bearing configured for horizontally mounting between a base and a chair, and having an upper plate and a lower plate defining a ball bearing race there between and a tension member disposed through a central rotational axis of the bi-plate ball bearing holding the upper plate to the lower plate, the tension member consisting essentially of a threaded metal tube fixed to a first one of the upper plate and the lower plate and held to a second one of the upper plate and the lower plate by a fastener, the threaded metal tube defining a passage through the central rotational axis of the bi-plate ball bearing, wherein the fastener comprises a jam nut having a continuous generally cylindrical outer perimeter and a slot disposed in an upper face thereof.

2. The assembly of claim 1, further comprising a chair seat attached to the upper plate of the bi-plate ball bearing.

3. The assembly of claim 2, further comprising a chair base attached to the lower plate of the bi-plate ball bearing.

4. The assembly of claim 2, further comprising at least one electrical wire passing through the threaded metal tube.

5. The assembly of claim 1, wherein the upper plate and the lower plate are formed from stamped metal plate.

6. The assembly of claim 1, wherein the tension member comprises a collar portion fixed around a base of the threaded metal tube.

7. The assembly of claim 1, wherein the bi-plate ball bearing lacks any additional load-bearing structure attaching the upper plate and lower plate, besides the tension member.

8. The assembly of claim 1, further comprising a torsion spring positioned around the metal tube with ends of the torsion spring disposed against tabs protruding from the respective upper and lower plates.

9. A swiveling chair, comprising:

a seat assembly mounted to a base assembly by a bi-plate ball bearing comprising an upper plate secured to a lower plate by a centrally disposed tension member consisting essentially of a metal tube;

a cable passing through the tension member from the base assembly into the seat assembly to provide an electrical connection at a first end of the cable for an electrical component located in the seat assembly, wherein the tension member is welded at a first end thereof to one of the upper and lower plates, and attached to the other of the upper and lower plates by a fastener comprising a jam nut having a continuous generally cylindrical outer perimeter and a slot disposed in an upper face thereof.

10. The swiveling chair of claim 9, further comprising a floorplate assembly attached to the base assembly.

11. The swiveling chair of claim 10, further comprising an electrical connector disposed outwardly from the floorplate assembly for connecting to an external circuit.

12. The swiveling chair of claim 11, wherein a second end of the cable is connected to an internal side of the electrical connector in the floorplate assembly.

13. The swiveling chair of claim 9, further comprising a removable cable connector placed in the cable adjacent the bi-plate ball bearing to facilitate assembly and disassembly of the base assembly to the seat assembly.

14. The swiveling chair of claim 9, wherein the electrical component in the seat assembly comprises an audio speaker assembly.

15. The swiveling chair of claim 9, wherein the electrical component in the seat assembly is selected from the group consisting of a motor, a display device, and an input device.

16. The swiveling chair of claim 9, wherein the bi-plate ball bearing lacks any additional load-bearing structure attaching the upper plate to the lower plate, besides the tension member.

* * * * *